US010446914B2

(12) United States Patent
Hu

(10) Patent No.: US 10,446,914 B2
(45) Date of Patent: Oct. 15, 2019

(54) ANTENNA STRUCTURE

(71) Applicant: Wistron Corp., New Taipei (TW)

(72) Inventor: Pei-Cheng Hu, New Taipei (TW)

(73) Assignee: WISTRON CORP., New Taipei (TW)

( * ) Notice: Subject to any disclaimer, the term of this patent is extended or adjusted under 35 U.S.C. 154(b) by 0 days.

(21) Appl. No.: 15/716,254

(22) Filed: Sep. 26, 2017

(65) Prior Publication Data

US 2019/0020098 A1 Jan. 17, 2019

(30) Foreign Application Priority Data

Jul. 14, 2017 (TW) ..... 106123620 A

(51) Int. Cl.

| | |
|---|---|
| ***H01Q 1/38*** | (2006.01) |
| ***H01Q 1/24*** | (2006.01) |
| ***H01Q 1/48*** | (2006.01) |
| ***H01Q 5/25*** | (2015.01) |
| ***H01Q 13/20*** | (2006.01) |
| ***H01Q 1/22*** | (2006.01) |
| ***H01Q 9/28*** | (2006.01) |

(52) U.S. Cl.

CPC ..... *H01Q 1/243* (2013.01); *H01Q 1/2266* (2013.01); *H01Q 1/38* (2013.01); *H01Q 1/48* (2013.01); *H01Q 5/25* (2015.01); *H01Q 9/285* (2013.01); *H01Q 13/20* (2013.01)

(58) Field of Classification Search

CPC .. H01Q 5/25; H01Q 1/38; H01Q 1/48; H01Q 13/20; H01Q 1/243

See application file for complete search history.

(56) References Cited

U.S. PATENT DOCUMENTS

| | | | | |
|---|---|---|---|---|
| 6,424,309 | B1 * | 7/2002 | Johnston | H01Q 9/28 343/725 |
| 2005/0052322 | A1 | 3/2005 | Park et al. | |
| 2005/0156787 | A1 | 7/2005 | Myoung et al. | |
| 2005/0184919 | A1 | 8/2005 | Yekeh Yazdandoost et al. | |
| 2006/0066487 | A1 | 3/2006 | Park et al. | |
| 2007/0279296 | A1 | 12/2007 | Sarabandi et al. | |

* cited by examiner

*Primary Examiner* — Dieu Hien T Duong

(57) ABSTRACT

An antenna structure includes a dielectric substrate and a metal element. The metal element is disposed on the dielectric substrate, and includes a transmission element and a radiation element. A first triangular hollow region and a second triangular hollow region are formed on the radiation element.

8 Claims, 4 Drawing Sheets

ANTENNA STRUCTURE

CROSS REFERENCE TO RELATED APPLICATIONS

This Application claims priority of Taiwan Patent Application No. 106123620 filed on Jul. 14, 2017, the entirety of which is incorporated by reference herein.

BACKGROUND OF THE INVENTION

Field of the Invention

The disclosure generally relates to an antenna structure, and more particularly, to an ultra-wideband antenna structure.

Description of the Related Art

With the advancements being made in mobile communication technology, mobile devices such as portable computers, mobile phones, multimedia players, and other hybrid functional portable electronic devices have become more common. To satisfy consumer demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Since many operation frequencies are in use, a traditional design usually requires a plurality of antennas for covering a wide frequency band, but this increases the difficulty of calibrating the mobile device. Accordingly, there is a need to propose a novel design, so as to solve the problem of the prior art.

SUMMARY OF THE INVENTION

In a preferred embodiment, the invention is directed to an antenna structure including a dielectric substrate and a metal element. The metal element is disposed on the dielectric substrate, and includes a transmission element and a radiation element. A first triangular hollow region and a second triangular hollow region are formed on the radiation element.

In some embodiments, the antenna structure is capable of completely covering a wide operation frequency band from 690 MHz to 6000 MHz.

In some embodiments, the transmission element is a coplanar waveguide.

In some embodiments, the dielectric substrate has an upper surface and a lower surface which are opposite to each other. The whole metal element is planar and is positioned on the upper surface of the dielectric substrate.

In some embodiments, the radiation element includes a common element, a first edge element, a second edge element, a first ground element, and a second ground element. The first triangular hollow region is surrounded by the common element, the first edge element, and the first ground element. The second triangular hollow region is surrounded by the common element, the second edge element, and the second ground element.

In some embodiments, each of the first edge element and the second edge element has a narrow and long straight-line shape.

In some embodiments, the common element is coupled through the first edge element to the first ground element. The common element is further coupled through the second edge element to the second ground element.

In some embodiments, the first triangular hollow region and the second triangular hollow region are symmetrical with respect to a central line of the metal element.

In some embodiments, each of the first triangular hollow region and the second triangle hollow region has an acute triangular shape.

In some embodiments, the acute triangular shape has a first interior angle from 50 to 60 degrees, a second interior angle from 76 to 90 degrees, and a third interior angle from 38 to 46 degrees.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the foregoing and other purposes, features and advantages of the invention, the embodiments and figures of the invention will be described in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
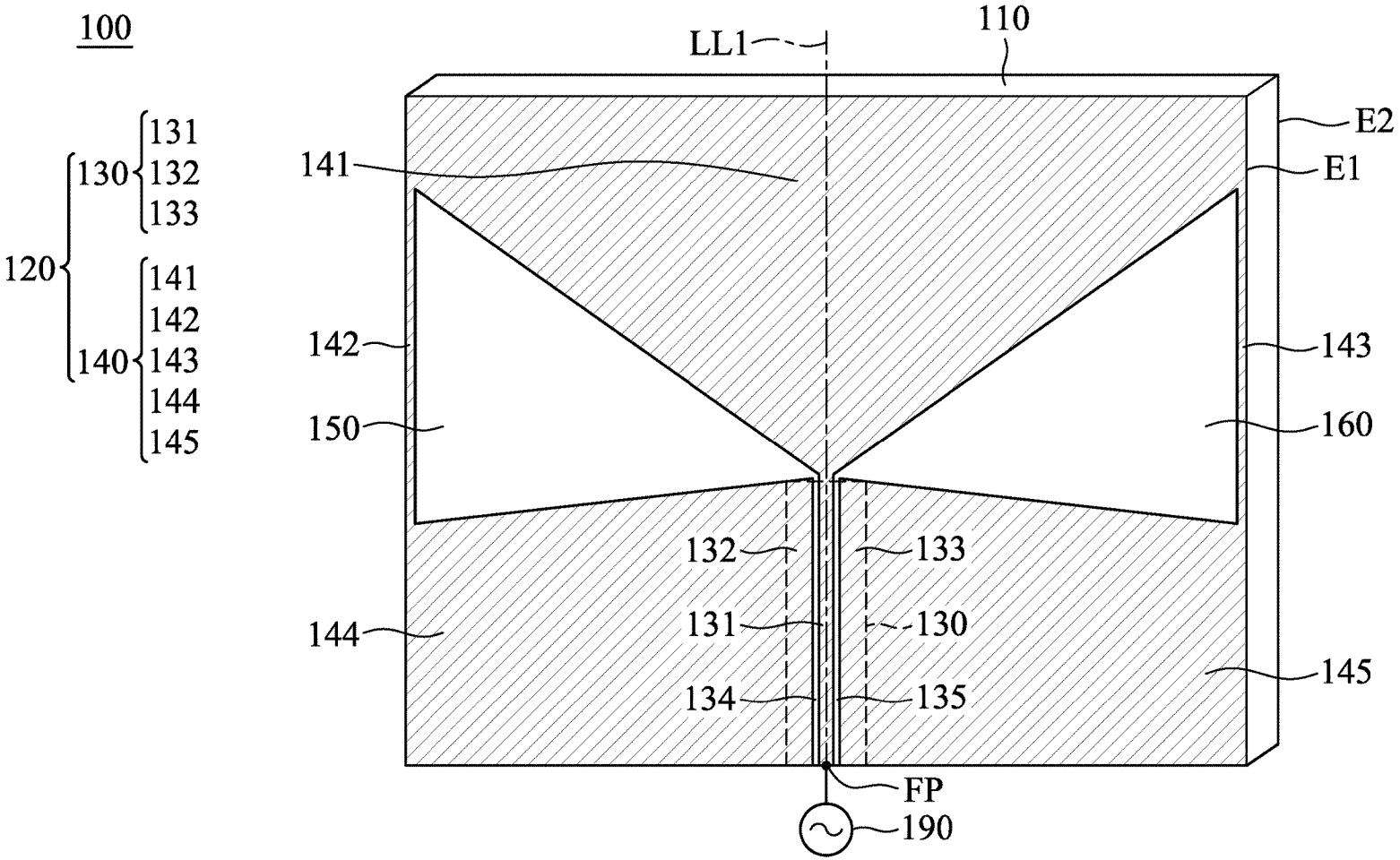
FIG. 1A is a perspective view of an antenna structure according to an embodiment of the invention.
Figure 1B:
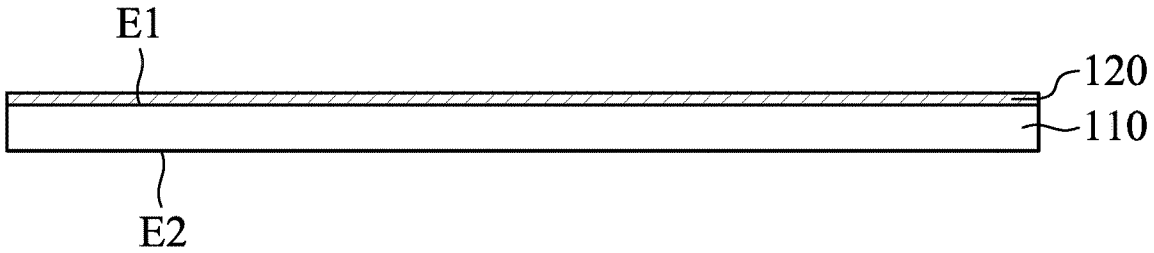
FIG. 1B is a side view of an antenna structure according to an embodiment of the invention.

FIG. 1A is a perspective view of an antenna structure 100 according to an embodiment of the invention. FIG. 1B is a side view of the antenna structure 100 according to an embodiment of the invention. Please refer to FIG. 1A and FIG. 1B together. The antenna structure 100 may be applied in a no-reflection laboratory, so as to calibrate the radiation performance of a mobile device. Alternatively, the antenna structure 100 may be applied in a wireless access point device. As shown in FIG. 1A and FIG. 1B, the antenna structure 100 includes a dielectric substrate 110 and a metal element 120. The dielectric substrate 110 may be a PCB (Printed Circuit Board) or an FR4 (Flame Retardant 4) substrate. The metal element 120 is disposed or printed on the dielectric substrate 110. The metal element 120 includes a transmission element 130 and a radiation element 140. A first triangular hollow region 150 and a second triangular hollow region 160 are formed on the radiation element 140. There is no metal material disposed inside the first triangular hollow region 150 and the second triangular hollow region 160 of the radiation element 140.

The antenna structure 100 can cover ultra-wideband operations. The following embodiments will introduce the detailed features of the antenna structure 100. It should be understood that these figures and descriptions are just exemplary, rather than limitations of the invention.

Please refer to FIG. 1A and FIG. 1B again. The dielectric substrate 110 has an upper surface E1 and a lower surface E2 which are opposite to each other. The whole metal element 120 is planar and is positioned on the upper surface E1 of the dielectric substrate 110. In other words, the metal element 120 does not extend to the lower surface E2 of the dielectric substrate 110.

The transmission element 130 of the metal element 120 is a CPW (Coplanar Waveguide). Specifically, the transmission element 130 includes a signal feeding element 131, a first signal grounding element 132, and a second signal grounding element 133. A first coupling gap 134 is formed between the signal feeding element 131 and the first signal grounding element 132. A second coupling gap 135 is formed between the signal feeding element 131 and the second signal grounding element 133. The first coupling gap 134 is connected to the aforementioned first triangular hollow region 150. The second coupling gap 135 is connected to the aforementioned second triangular hollow region 160. The signal feeding element 131 may substantially have a straight-line shape. The signal feeding element 131 is completely separate from the first signal grounding element 132 and the second signal grounding element 133. A feeding point FP of the signal feeding element 131 is coupled to a signal source 190. The signal source 190 may be an RF (Radio Frequency) module for exciting the antenna structure 100.

The radiation element 140 includes a common element 141, a first edge element 142, a second edge element 143, a first ground element 144, and a second ground element 145. The common element 140 may have an isosceles triangular shape or a pentagonal shape having two right angles. Each of the first edge element 142 and the second edge element 143 may substantially have a narrow and long straight-line shape. Each of the first ground element 144 and the second ground element 145 may substantially have a trapezoidal shape. The aforementioned first triangular hollow region 150 is surrounded by the common element 141, the first edge element 142, and the first ground element 144. The aforementioned second triangular hollow region 160 is surrounded by the common element 141, the second edge element 143, and the second ground element 145. Specifically, the common element 141 is coupled through the first edge element 142 to the first ground element 144, and the common element 141 is further coupled through the second edge element 143 to the second ground element 145. In addition, the common element 141 of the radiation element 140 may be further coupled to the signal feeding element 131 of the transmission element 130, the first ground element 144 of the radiation element 140 may be further coupled to the first signal grounding element 132 of the transmission element 130, and the second ground element 145 of the radiation element 140 may be further coupled to the second signal grounding element 133 of the transmission element 130.

The metal element 120 may be a line-symmetry pattern. For example, the first triangular hollow region 150 and the second triangular hollow region 160 may be symmetrical with respect to a central line LL1 of the metal element 120. Similarly, each of the transmission element 130 and the radiation element 140 may be symmetrical with respect to the central line LL1. In some embodiments, each of the first triangular hollow region 150 and the second triangular hollow region 160 substantially has an acute triangular shape. Specifically, the aforementioned acute triangular shape has a first interior angle θ1, a second interior angle θ2, and a third interior angle θ3. For example, the first interior angle θ1 may be from 50 to 60 degrees, such as 55 degrees; the second interior angle θ2 may be from 76 to 90 degrees, such as 83 degrees; and the third interior angle θ3 may be from 38 to 46 degrees, such as 42 degrees. The radiation performance of the antenna structure 100 is sensitive to a change in each interior angle of the acute triangular shape. According to the practical measurement, within the above angle ranges, the antenna structure 100 can have the maximized operation frequency bandwidth and the optimized impedance matching.

Figure 2:
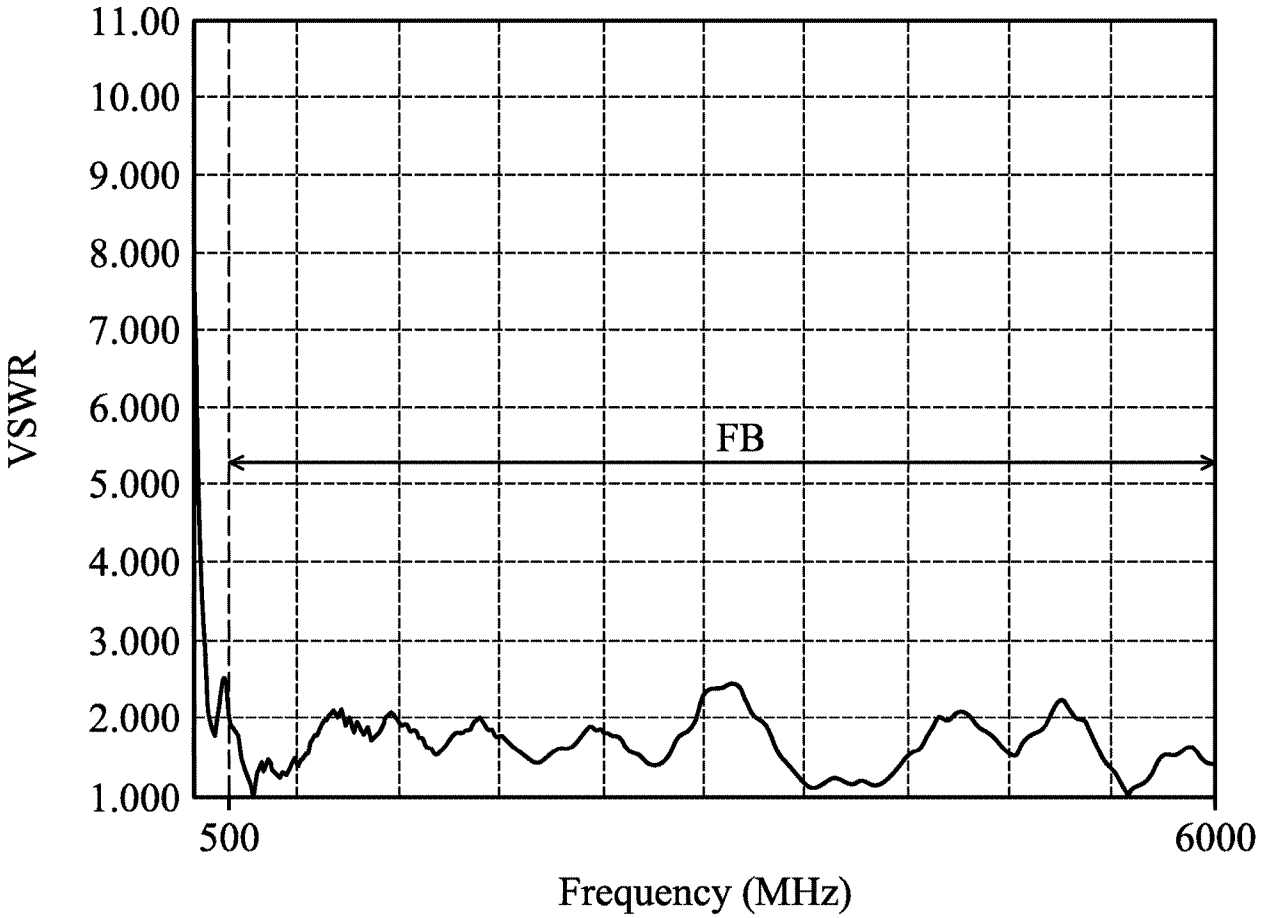
FIG. 2 is a diagram of VSWR (Voltage Standing Wave Ratio) of an antenna structure according to an embodiment of the invention.

FIG. 2 is a diagram of VSWR (Voltage Standing Wave Ratio) of the antenna structure 100 according to an embodiment of the invention. The horizontal axis represents the operation frequency (MHz), and the vertical axis represents the VSWR. According to the measurement of FIG. 2, the antenna structure 100 is capable of covering a wide operation frequency band FB from 690 MHz to 6000 MHz completely (i.e., within the wide operation frequency band FB, the VSWR of the antenna structure 100 is smaller than 3 or 2). Therefore, the antenna structure 100 at least supports the multiband operations of GSM/WCDMA/TD-SCDMA/CDMA/LTE/TDD-LTE/Wi-Fi. According to the practical measurement, the antenna efficiency of the antenna structure 100 operating in the wide operation frequency band FB is higher than 56%, and it can meet the practical requirement of application of a general mobile communication device. If the antenna structure 100 is applied to a no-reflection laboratory, a DUT (Device Under Test) will be calibrated for every frequency band, without changing calibration antennas. Thus, the total calibration time is decreased, and the antenna test efficiency is increased.

Regarding the antenna theory, the radiation element 140 is fed in by the signal source 190 through the transmission element 130. The radiation element 140 is excited to generate at least a first current path and a second current path. Specifically, the first current path is from the common element 141 through the first edge element 142 to the first ground element 144, and the second current path is from the common element 141 through the second edge element 143 to the second ground element 145. Since the width of the common element 141 and the width of the first ground element 144 are sufficiently large, the first current path can be excited to generate sufficiently wide operation bandwidth. The first edge element 142 can conduct currents flowing between the common element 141 and the first ground element 144. Similarly, since the width of the common element 141 and the width of the second ground element 145 are sufficiently large, the second current path can be excited to generate sufficiently wide operation bandwidth. The second edge element 143 can conduct currents flowing between the common element 141 and the second ground element 145. It should be noted that the transmission element 130 is implemented with a CPW, and therefore the first ground element 144 and the second ground element 145 of the radiation element 140 contribute to the first current path and the second current path. Conversely, if the transmission element 130 were replaced with a traditional microstrip line, the first ground element 144 and the second ground element 145 of the radiation element 140 could not be excited to generate radiation. In comparison to a traditional slot antenna or a traditional monopole antenna, the proposed antenna structure 100 is capable of covering the wide operation frequency band FB from 690 MHz to 6000 MHz completely (in fact, also covering an ultra-high frequency band from 6000 MHz to 10000 MHz), so as to solve the problem of the prior art in which the antenna bandwidth is too small.

Figure 3:
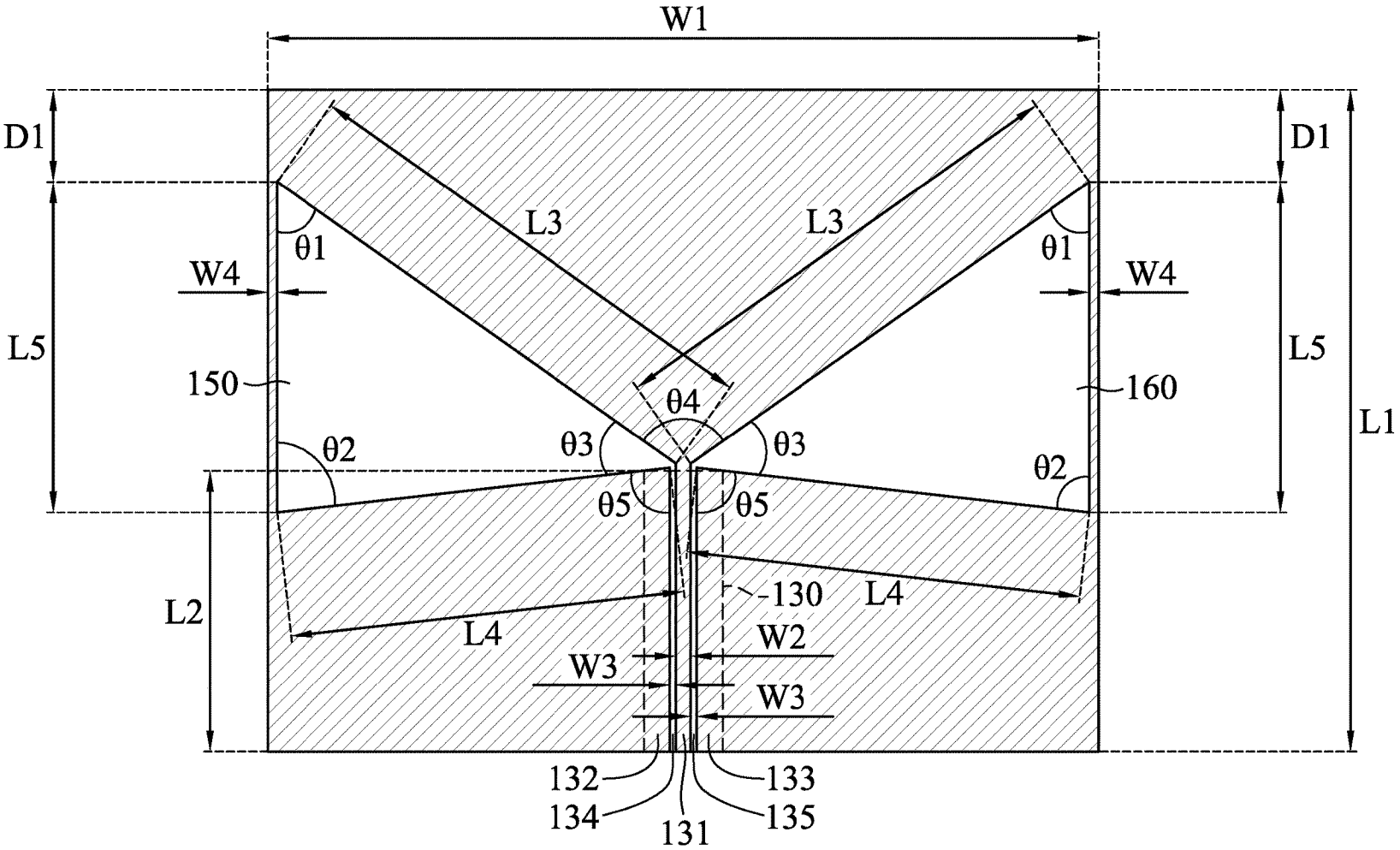
FIG. 3 is a diagram of element sizes of an antenna structure according to an embodiment of the invention.

FIG. 3 is a diagram of element sizes of the antenna structure 100 according to an embodiment of the invention. In the embodiment of FIG. 3, the element sizes of the antenna structure 100 are as follows. The thickness of the dielectric substrate 110 is about 1.6 mm. The length L1 of the metal element 120 is substantially from 0.4 to 0.6 wavelength (0.4λ to 0.6λ) of the lowest frequency of the wide operation frequency band FB, such as 0.5 wavelength (0.5λ). The width W1 of the metal element 120 is substantially from 0.6 to 0.7 wavelength (0.6λ to 0.7λ) of the lowest frequency of the wide operation frequency band FB, such as 0.65 wavelength (0.65λ). The length L2 of the transmission element 130 is substantially from 0.2 to 0.3 wavelength (0.2λ to 0.3λ) of the lowest frequency of the wide operation frequency band FB, such as 0.22 wavelength (0.22λ). The length L3 of the first side of each of the first triangular hollow region 150 and the second triangular hollow region 160 is substantially from 0.3 to 0.4 wavelength (0.3λ to 0.4λ) of the lowest frequency of the wide operation frequency band FB, such as 0.38 wavelength (0.38λ). The length L4 of the second side of each of the first triangular hollow region 150 and the second triangular hollow region 160 is substantially from 0.3 to 0.4 wavelength (0.3λ to 0.4λ) of the lowest frequency of the wide operation frequency band FB, such as 0.31 wavelength (0.31λ). The length L5 of the third side of each of the first triangular hollow region 150 and the second triangular hollow region 160 is substantially from 0.2 to 0.3 wavelength (0.2λ to 0.3λ) of the lowest frequency of the wide operation frequency band FB, such as 0.26 wavelength (0.26λ). The width W2 of the signal feeding element 131 is substantially from 3 mm to 4 mm, such as 3.2 mm. The width W3 of each of the first coupling gap 134 and the second coupling gap 135 is substantially from 0.8 mm to 1 mm, such as 0.9 mm. The width W4 of each of the first edge element 142 and the second edge element 143 is substantially from 1 mm to 3 mm, such as 2 mm. The distance D1 from each of the first triangular hollow region 150 and the second triangular hollow region 160 to the edge of the common element 141 is substantially from 15 mm to 25 mm, such as 20 mm. A first angle θ4 between the first triangular hollow region 150 and the second triangular hollow region 160 is substantially from 105 to 115 degrees, such as 110 degrees. A second angle θ5 between the first triangular hollow region 150 and the first coupling gap 134 (or between the second triangular hollow region 160 and the second coupling gap 135) is substantially from 76 to 90 degrees, such as 83 degrees. The aforementioned element sizes are determined according to many experiment results, and they can help to optimize the operation bandwidth and the impedance matching of the antenna structure 100.

The invention proposes a novel antenna structure. In comparison to the conventional design, the invention has the advantages of: (1) using a single antenna structure to cover a wide operation frequency band from 690 MHz to 6000 MHz, (2) making the antenna structure only occupy a single surface of a dielectric substrate, and (3) simplifying the antenna structure, such that the antenna structure can be easily produced and manufactured. Therefore, the invention is suitable for application in the calibration of the radiation performance of a variety of mobile devices.

Note that the above element parameters are not limitations of the invention. A designer can fine-tune these settings or values according to different requirements. It should be understood that the antenna structure of the invention is not limited to the configurations of FIGS. 1-3. The invention may include any one or more features of any one or more embodiments of FIGS. 1-3. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with the true scope of the disclosed embodiments being indicated by the following claims and their equivalents.

What is claimed is:

1. An antenna structure, comprising:

a dielectric substrate; and a metal element, disposed on the dielectric substrate, and comprising a transmission element and a radiation element;

wherein a first triangular hollow region and a second triangular hollow region are formed on the radiation element;

wherein the antenna structure is capable of completely covering a wide operation frequency band from 690 MHz to 6000 MHz;

wherein each of the first triangular hollow region and the second triangular hollow region has an acute triangular shape;

wherein the acute triangular shape has a first interior angle from 50 to 60 degrees, a second interior angle from 76 to 90 degrees, and a third interior angle from 38 to 46 degrees;

wherein the dielectric substrate is planar and has an upper surface and a lower surface which are opposite to each other, and wherein the whole metal element is planar and is positioned on and parallel to the upper surface of the dielectric substrate.

2. The antenna structure as claimed in claim 1, wherein the transmission element is a coplanar waveguide.

3. The antenna structure as claimed in claim 1, wherein the radiation element comprises a common element, a first edge element, a second edge element, a first ground element, and a second ground element, wherein the first triangular hollow region is surrounded by the common element, the first edge element, and the first ground element, and wherein the second triangular hollow region is surrounded by the common element, the second edge element, and the second ground element.

4. The antenna structure as claimed in claim 3, wherein each of the first edge element and the second edge element has a narrow and long straight-line shape.

5. The antenna structure as claimed in claim 3, wherein the common element is coupled through the first edge element to the first ground element, and wherein the common element is further coupled through the second edge element to the second ground element.

6. The antenna structure as claimed in claim 1, wherein the first triangular hollow region and the second triangular hollow region are symmetrical with respect to a central line of the metal element.

7. The antenna structure as claimed in claim 1, wherein a length of the metal element is substantially from 0.4 to 0.6 wavelength of the lowest frequency of the wide operation frequency band.

8. The antenna structure as claimed in claim 1, wherein a width of the metal element is substantially from 0.6 to 0.7 wavelength of the lowest frequency of the wide operation frequency band.

* * * * *